US010418758B2

(12) United States Patent
Vigouroux et al.

(10) Patent No.: US 10,418,758 B2
(45) Date of Patent: Sep. 17, 2019

(54) ELECTRICAL SYSTEM COMPRISING AN ELECTRICAL UNIT AND AN INTERCHANGEABLE CONNECTION MODULE

(71) Applicant: Schneider Electric Industries SAS, Rueil Malmaison (FR)

(72) Inventors: Didier Vigouroux, Villard Bonnot (FR); Thomas Machizaud, Seyssins (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 16/178,902

(22) Filed: Nov. 2, 2018

(65) Prior Publication Data

US 2019/0157815 A1 May 23, 2019

(30) Foreign Application Priority Data

Nov. 20, 2017 (FR) ..... 17 60908

(51) Int. Cl.
*H01R 13/70* (2006.01)
*H01H 71/08* (2006.01)

(52) U.S. Cl.
CPC ..... *H01R 13/70* (2013.01); *H01H 71/08* (2013.01)

(58) Field of Classification Search
CPC ..... H01R 13/70; H01H 71/08
See application file for complete search history.

(56) References Cited

U.S. PATENT DOCUMENTS 5,652,420 A * 7/1997 Innes ..... H01H 71/02 200/307
2007/0082551 A1 4/2007 Oesterhaus
2015/0318133 A1* 11/2015 Lauraire ..... H01H 50/002 335/185

(Continued)

FOREIGN PATENT DOCUMENTS

EP 1 667 286 A2 6/2006
EP 2 182 539 A1 5/2010
EP 3 176 876 A1 6/2017

(Continued)

OTHER PUBLICATIONS

French Preliminary Search Report dated May 2, 2018 in French Application 17 60908, filed on Nov. 20, 2017 (with English Translation of Categories of Cited Documents & Written Opinion).

*Primary Examiner* — Abdullah A Riyami
*Assistant Examiner* — Nader J Alhawamdeh
(74) *Attorney, Agent, or Firm* — Oblon, McClelland, Maier & Neustadt, L.L.P.

(57) ABSTRACT

An interchangeable connection module for electrically connecting an electrical switching unit to an electrical installation includes a connecting part and an actuation button. The button is translatably movable between a rest position and a pressed position in order to move a corresponding deformable elastic strip into a depressed position thereof when the module is connected with the unit and the button is moved into the pressed position thereof. The connection module includes a locking device that is capable of cooperating with a locking interface of the unit, it being possible to actuate this locking device with the button.

11 Claims, 4 Drawing Sheets

(56) References Cited

U.S. PATENT DOCUMENTS

2016/0164200 A1* 6/2016 Grumel ..... H01R 11/07
335/8
2018/0011129 A1* 1/2018 Houbre ..... G01R 15/181

FOREIGN PATENT DOCUMENTS

WO WO 2014/209143 A1 12/2014
WO WO-2014209143 A1 * 12/2014 ..... H01R 13/635

* cited by examiner

ELECTRICAL SYSTEM COMPRISING AN ELECTRICAL UNIT AND AN INTERCHANGEABLE CONNECTION MODULE

The present invention relates to an interchangeable connection module and an electrical system comprising an electrical switching unit and an interchangeable connection module of this type.

Electrical switching units, such as circuit breakers, contactors, disconnectors and also relays, are typically associated with electrical installations with a view to controlling operation thereof and/or providing electrical protection.

These switching units are thus intended to be electrically connected to an electrical installation. This connection is achieved by means of electrical conductors, or electrical links, generally of the wire type, that are connected to connection terminals of the unit.

One drawback is that there is a great number of ways in which to achieve this connection. For example, it is known to use wire-type conductors terminating in bare cables, or in open lugs, or in closed lugs, or in other types of connectors. The connection terminals of the unit thus have to be adapted as a result. Therefore, one and the same switching unit has to be produced in a number of variants, each adapted to a particular type of connection. This situation is unsatisfactory from an industrial standpoint as it requires the number of references for each type of unit to be multiplied.

It is these drawbacks that the invention intends more particularly to remedy by proposing a connection module for an electrical switching unit, allowing greater versatility, an improved connection and also greater flexibility of use.

To that end, the invention relates to an interchangeable connection module for electrically connecting an electrical switching unit to an electrical installation by means of electrical links, the electrical unit including a connection interface including at least one electrical contact and at least one elastic holding strip that is deformable between a depressed position and a released position, this connection module being characterized in that it can be moved between a position in which it is connected with the unit and a position in which it is disconnected from the unit, in that it includes a casing, at least one connection piece and an actuation button, each connection piece being intended to provide an electrical connection between an end of an electrical link and one of the electrical contacts of the unit when the connection module is connected with the unit, and including at least one connection portion that projects outside the casing, each connection piece being held in contact with an electrical contact of the unit by a corresponding elastic holding strip of the unit when this strip is in the released position thereof and the module is connected with the unit, this holding not being exerted when the strip is in the depressed position thereof, the button being translatably movable, relative to the casing of the module, between a rest position and a pressed position and including at least one bearing portion projecting outside the casing when the button is in the pressed position thereof, each bearing portion being adapted in order to move a corresponding deformable elastic strip into the depressed position thereof when the module is connected with the unit and the button is moved into the pressed position thereof, and in that the connection module includes a locking device that is capable of cooperating with a locking interface of the unit, it being possible to actuate this locking device by means of the button.

By virtue of the invention, the interchangeable connection module offers greater versatility for the assembly. Disconnection of the connection module is achieved by simple pressure on the button, without the need for complex tools, which offers greater flexibility of use.

According to advantageous, but non-mandatory aspects of the invention, a connection module of this type may incorporate one or more of the following features taken separately or in any technically acceptable combination:

- The locking device includes pivoting hooks capable of cooperating with grooves formed on the unit and forming a locking interface of the unit, the hooks being arranged in order to be moved from a closed position into an open position when the button is moved from the rest position thereof into the pressed position thereof.
- Each hook includes a cam and the button includes at least one additional bearing portion, the cam being aligned with the additional bearing portion such that a force exerted on the cam by the translation of the additional bearing portion gives rise to a movement of the hook into the open position thereof.
- The hooks are formed as a single piece with the casing of the connection module.
- Each connection portion is provided with notches that define stops for receiving a free end of the elastic holding strip when this elastic holding strip is in the released position thereof.
- The button includes a pusher that is proud of and extends outside the casing of the connection module when the button is in the rest position thereof.
- The casing of the connection module includes an electrically insulating screen that separates the button from the connection pieces.
- The connection module includes, for each connection piece, a fixing element for mechanically connecting an electrical link to a connection piece.
- Each connection piece includes two connection portions, and each connection portion of one and the same piece is held in contact with the corresponding electrical contact by a dedicated elastic holding strip when this strip is in the released position thereof and the module is connected with the unit.

According to another aspect, the invention relates to an electrical system including an electrical switching unit and an interchangeable connection module for electrically connecting the unit to an electrical installation by means of electrical links, this electrical system being characterized in that the connection module is as described above, in that the electrical unit includes a connection interface including at least one electrical contact and at least one elastic holding strip, each connection piece being intended to provide an electrical connection between an end of an electrical link and one of the electrical contacts of the unit when the connection module is connected with the unit and including at least one connection portion that projects outside the casing, and in that the electrical unit includes a locking interface that complements the locking device.

According to advantageous, but non-mandatory aspects of the invention, a system of this type may incorporate the following feature:

- the unit contains a housing, a wall of which is intended to receive the connection module, the electrical contacts and the elastic holding strips being provided inside the casing behind the wall and the wall including slots for the passage of the connection portions and the bearing portions.

The invention will be better understood and further advantages thereof will become more clearly apparent in light of the following description of an embodiment of an interchangeable connection module for a switching unit, which is given solely by way of example and with reference to the appended drawings, in which.

Figure 1:
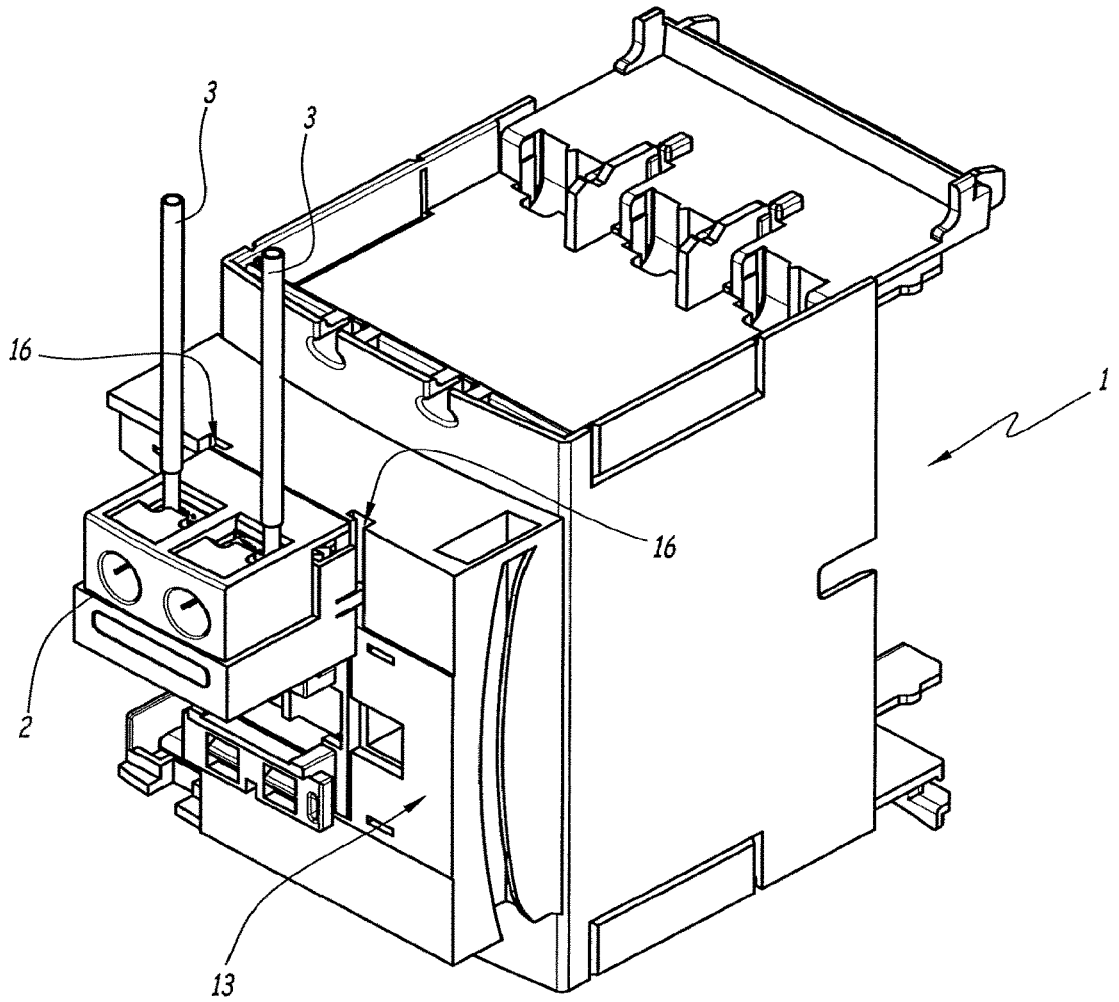
FIG. 1 is a schematic illustration of one embodiment of an electrical system according to the invention, which includes an electrical switching unit and an interchangeable connection module for connecting the electrical switching unit to an electrical installation.

FIG. 1 shows an example of an electrical system including an electrical switching unit 1 associated with an interchangeable connection module 2. The connection module 2, also known as a terminal, makes it possible to electrically connect the unit 1 to an electrical installation by means of electrical links 3, such as cables. The connection module 2 can be moved between a position in which it is connected with the unit 1 and a position in which it is disconnected from the unit 1.

The unit 1 is, here, a unit for cutting off an electrical current, such as a circuit breaker. According to variants, the unit 1 is a contactor, or a disconnector, or any other electrical protection and/or electrical switching unit.

As illustrated in FIGS. 1, 4, 5 and 6, the unit 1 includes a casing and a connection interface 10 intended to receive the connection module 2.

In the example illustrated, the connection module 2 is adapted in order to connect two conductors 3 to two corresponding, different poles of the unit 1. This number of poles is, however, not limiting, and according to other embodiments the number of poles is different, for example greater than 2 or equal to 1.

For each pole, the interface 10 comprises an electrical contact 11 and an elastic holding strip 12.

The contact 11 acts as connection terminal intended to electrically connect the unit 1 to an exterior installation, thus making it possible to convey an electric current between the unit 1 and the exterior. The contact 11 is, for example, a rigid piece made from metallic material, such as copper.

When the module 2 is connected with the unit 1, each link 3 is connected to a contact 11 by means of a connection piece 21 of the module 2, described below.

The strip 12 can be deformed elastically between a depressed position and a released position. One end of the strip 12 is integral with the casing of the unit 1, whilst an opposite end remains free. For example, the strip 12 is made from a metallic material.

Generally, each strip 12 is arranged such that, when the module 2 is connected with the unit 1 and the strip 12 is in the released position thereof, each connection piece 21 of the module 2 is kept in contact with a corresponding electrical contact 11 by virtue of the bearing force exerted by this strip 12. In other words, the strip 12 touches the connection piece 21. This holding opposes the translational withdrawal of the connection piece 21. When the strip 12 is in the depressed position thereof it does not exert this holding, however, on the connection piece 21. The strip 12 is arranged in order to elastically return to the released position thereof, for example owing to its form and/or to the nature of the material used.

In this example, the strip 12 has a curved form. In a purely illustrative and non-limiting manner, the strip 12 here has a form in which it is curved over on itself such that its cross section, taken according to a vertical plane of the unit 1, has a hair grip form, as illustrated more specifically in FIGS. 4 to 6. Other configurations of the strip 12 are, however, possible, for example a straight and vertical strip form.

Preferably, the contacts 11 and the strips 12 are arranged behind a wall 13 of the unit 1. This limits the likelihood of a user accidentally gaining access thereto.

The wall 13 here forms part of the casing of the unit 1. In this example, the wall 13 forms a front face of the unit 1.

For each pole, the wall 13 includes through-slots 14, 15 that allow access respectively to the electrical contact 11 and to the holding strip 12 from the exterior of the casing of the unit 1.

In this example, for each pole, the electrical contact 11 and the strip 12 are superposed on one another. The poles of the unit 1 are arranged side-by-side.

The unit 1 advantageously includes a locking interface for mechanically connecting the module 2 removably to the casing of the unit 1.

According to an example, the unit 1 includes, to that end, grooves 16, the role of which is described below. In the example illustrated, the grooves 16 are arranged vertically.

Figure 3:
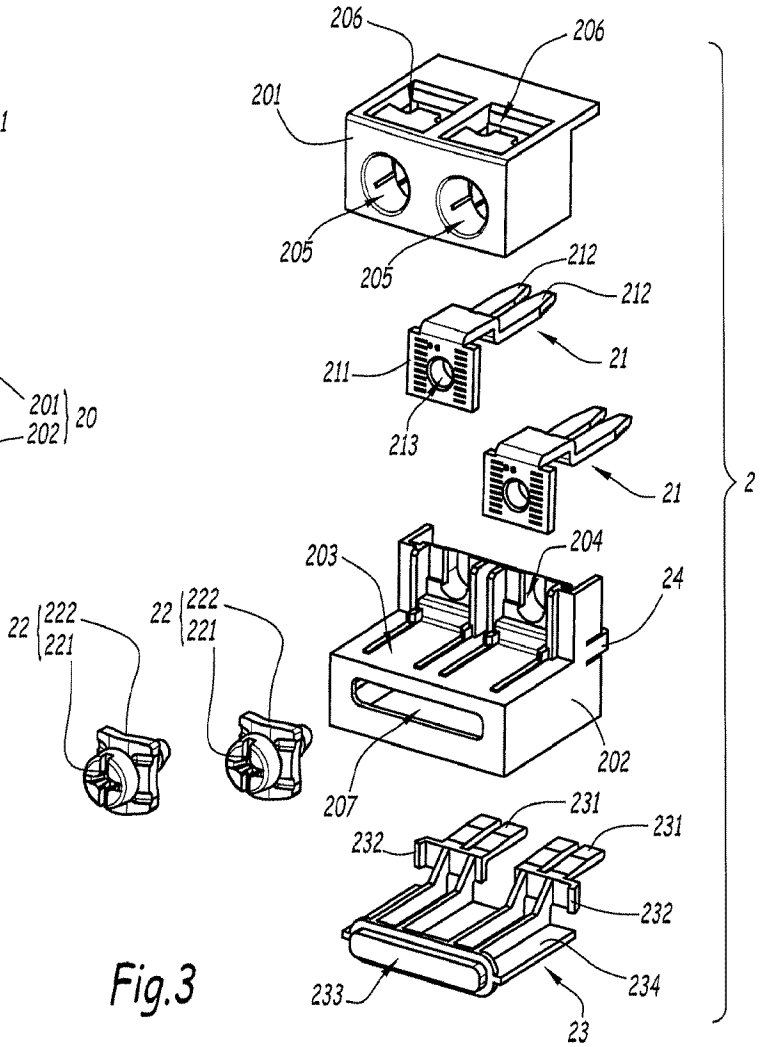
FIG. 3 is a schematic illustration, according to an expanded view, of the connection module of FIG. 2.
Figure 2:
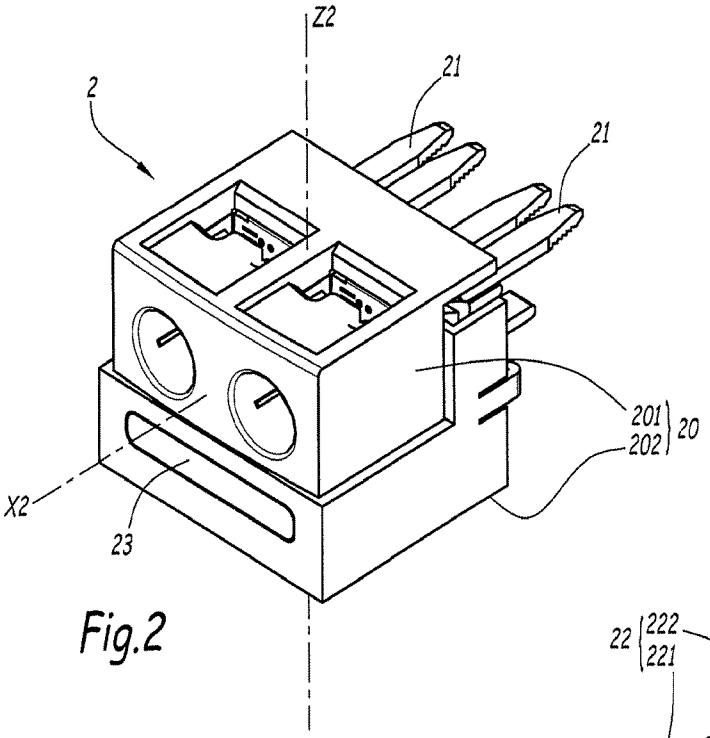
FIG. 2 is a schematic illustration, according to an isometric perspective view, of the connection module of FIG. 1.

As illustrated in FIGS. 2 and 3, the module 2 includes a casing 20 and, for each pole, a connection piece 21 and a fixing element 22.

In FIG. 2, a longitudinal geometric axis of the module 2 is denoted "X2" and a vertical transverse geometric axis of the module 2, perpendicular to the axis X2, is denoted "Z2".

For example, the casing 20 is produced by moulding from a polymeric material, such as plastics.

Each connection piece 21 is intended to provide an electrical connection between a link 3 and one of the contacts 11 of the unit 1. The piece 21 is preferably produced from metallic material, for example copper.

Each piece 21 includes at least one connection portion 212 that projects outside the casing 20. For example, the connection portion 212 has an elongate form parallel to the axis X2, in the form of a strip or a rod.

Advantageously, the connection portions 212 include notches 214 for receiving the free end of the strip 12. These notches 214 give rise to superior mechanical strength of the module 2 when it is connected with the unit 1.

Each fixing element 22 is associated with a connection piece 21 and is adapted in order to provide a mechanical connection of the end of the link 3 with the corresponding connection piece 21.

For the purposes of simplification, the connection pieces 21 are here identical with one another, and the elements 22 are here likewise identical to one another such that only one example of each of them is described in detail.

The form of the connection pieces 21 is adapted as a function of the type of connection used on the ends of the links 3.

In the example illustrated, the links 3 are cables formed from an electrically conducting central portion 31 encased in an electrically insulating sheath 32. At the end of the link 3 that is intended to be connected, the central portion 31 is stripped in order to allow electrical connection with the connection piece 21.

According to the embodiment illustrated, each connection piece 21 includes a contact plate 221, of planar form, here, and two connection portions 212, of strip form, here, that project perpendicularly relative to the contact plate 211. The contact plate 211 is pierced with a through-hole 213, which preferably has an internal thread. The contact plate 211 and the connection portions 212 are here produced as a single piece.

In this illustrative example, the unit 1 includes, for each of the connection pieces 21, that is to say for each pole, as many strips 12 as there are connection portions 212. In this case, there are two different strips 12 for each pole. Each of these two strips 12 is intended to come into contact with one of the connection portions 212. This makes it possible to improve the fixing of the casing 2 when it is connected with the unit 1. In a variant, the number of strips 12 for each pole may be different.

The fixing elements 22 each include a screw 221 and a clamp 222. In order to connect a link 3 to the corresponding connection piece 21, the end of the stripped central portion 31 is placed in contact with the contact plate 211 and is held by virtue of the clamp 222 by tightening of the screw 221. The hole 213 makes it possible to receive the end of the screw 221.

According to variants that have not been illustrated, the links 3 are connected differently, for example by means of lugs provided at the ends of the links 3. The connection pieces 21 and/or the fixing elements 22 are thus adapted as a result, for example by incorporating a connector of complementary form.

The fixing elements 22 may then be omitted. Alternatively, the fixing elements 22 may be integrated into the connection pieces 21.

According to other embodiments, one and the same module 2 may be adapted in order to receive conductors 3 connected differently. In other words, the connection pieces 21 and the fixing elements 22 of one and the same module 2 may be produced differently.

The module 2 also includes an actuation button 23 that is translatably movable, relative to the casing 20, between a rest position and a pressed position, according to a direction of movement that, here, is parallel to the axis X2. The button 23 is intended to be actuated by a user from outside the casing 20.

The button 23 is, for example, produced from a rigid material, such as moulded plastics. The button 23 is preferably produced as a single piece.

For example, the button 23 is associated with elastic return means, such as one or more springs, which elastically bring the button 23 back to the rest position thereof.

The button 23 includes bearing portions 231 that are rigid and integral with the body of the button 23, which project outside the casing 20 when the button 23 is in the pressed position thereof. There is at least one bearing portion 231 for each pole.

The bearing portions 231 are adapted in order to move the corresponding strips 12 into the depressed position thereof when the module 2 is connected with the unit 1 and the button 23 is moved into the pressed position thereof.

For example, each bearing portion 231 is aligned facing a strip 12 parallel to the axis of movement of the button 23.

In the example illustrated, each bearing portion 231 includes two elongate fingers and extends parallel to the direction X2.

The portions 212 and the bearing portions 231 are here superposed vertically on one another, in a manner corresponding to the arrangement of the contact 11 and of the strip 12.

It will therefore be understood that the slots 14 and 15 are arranged and dimensioned such as to allow the passage of the connection portions 212 and of the bearing portions 231, respectively.

The button 23 also includes a pusher 233 forming a surface on which a user is able to press in order to move the button 23, for example using a tool 4 or directly with his/her fingers.

According to optional embodiments, the pusher 233 forms a boss that extends through the opening 207 outside the casing 20 when the button 23 is in the rest position thereof. This enables a user to press more easily on the button 23 in order to move it into the depressed position, without need for a tool 4.

Optionally, the translational movement of the button 23 relative to the casing 20 is facilitated by guide elements 234 cooperating with guide rails (not illustrated) arranged inside the casing 20.

Preferably, the button 23 is accommodated inside the casing 20, being separated from the connection pieces 21 and from the fixing elements 22 by an electrically insulating screen 203. This limits the likelihood of a user pressing on the button 23 accidentally being in electrical contact with the connection pieces 21 or with the links 3.

According to embodiments, as illustrated in FIG. 2, the casing 20 includes a first casing part 201 that contains the connection pieces 21 and at least some of the fixing elements 22, and a second casing part 202 that contains the button 23. The second part 202 includes the insulating screen 203.

In this example, the casing part 201 includes first openings 205 allowing the passage of a tool for adjusting the fixing elements 22 and includes second openings 206 allowing the passage of the ends of the links 3. The casing part 202 includes an opening 207 allowing the passage of the pusher 233.

Advantageously, the module 2 includes a locking device that is complementary with the locking interface provided on the unit 1. This locking device can advantageously be actuated by the button 23.

According to embodiments, the module 2 includes, to this end, movable hooks 24. The hooks 24 are here intended to cooperate with the grooves 16. For example, the grooves 16 include an attachment portion on which the hooks 24 bear.

Figure 7:
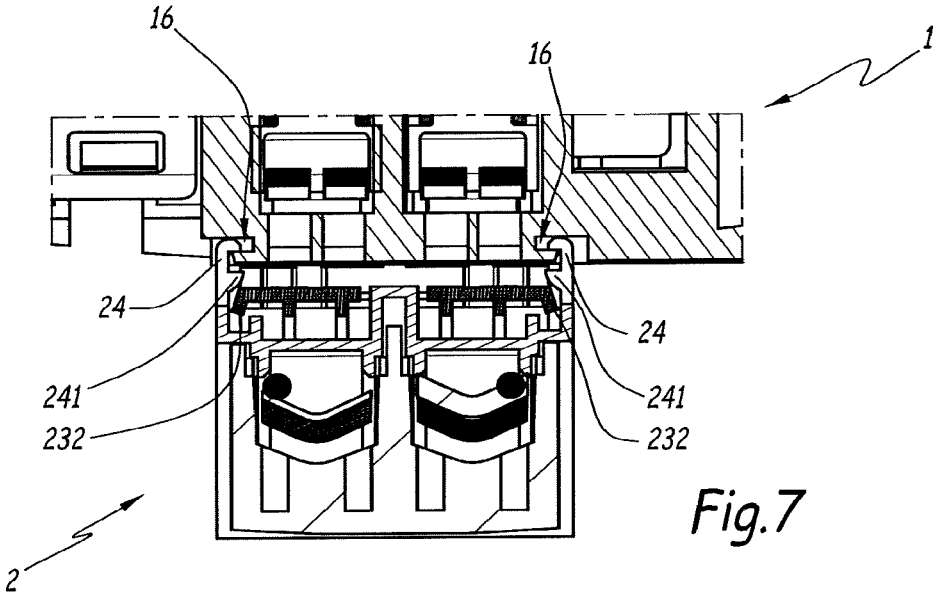
FIGS. 7 and 8 are schematic illustrations of the connection module of FIG. 2, according to a transverse sectional view seen from above, comprising a locking device in locked and unlocked positions, respectively.
Figure 8:
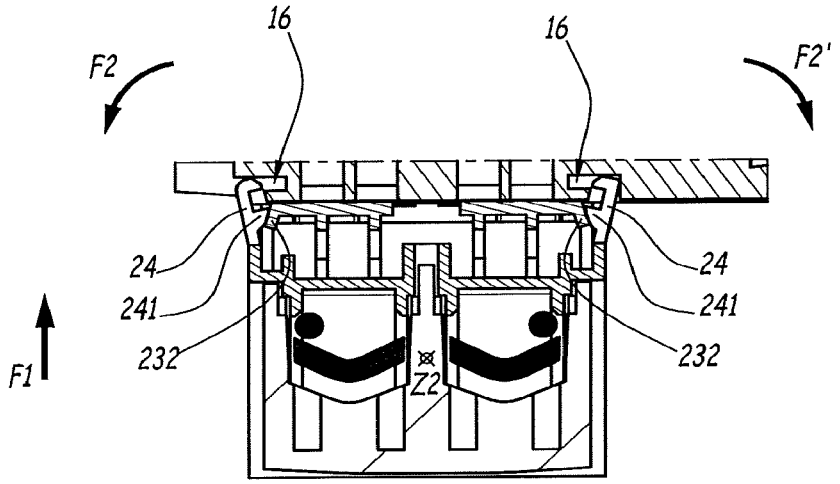

As illustrated in FIGS. 7 and 8, the hooks 24 are mounted pivotably relative to the casing 20, about axes of rotation parallel to the axis Z2. The hooks 24 can be moved between a closed position illustrated in FIG. 7 and an open position illustrated in FIG. 8.

When the module 2 is connected with the unit 1 and the hooks 24 are in the closed position thereof, said hooks are received in the grooves 16 and secure the module 2 to the unit 1 by preventing the withdrawal of the module 2 by translation along the axis X2.

In other words, in the closed position and when the module 2 is received on the interface 10 of the unit 1, the hooks 24 are engaged in the grooves 16, which prevents the withdrawal of the module 2. In the open position, the hooks 24 are free of the grooves 16.

The hooks 24 are here provided on lateral faces of the casing 20, close to that face of the casing 20 that is turned towards the face 13 when the module 2 is connected with the unit 1. The hooks 24 are here arranged symmetrically on either side of the casing 20, relative to a vertical plane of the module 2.

For example, the hooks 24 are produced as a single piece with the rest of the casing 20. Each hook 24 is connected to the rest of the casing 20 by a portion of material forming a hinge that allows the elastic pivoting of the hook 24, whilst being, furthermore, separated from the rest of the casing 20 by a cutout.

The hooks 24 are adapted in order to be moved from the closed position thereof towards the open position thereof by moving the button 23 from the rest position thereof into the pressed position thereof. In other words, it is possible to actuate the hooks 24 by means of the button 23.

Preferably, each hook 24 includes a cam 241 arranged such that the force exerted on the cam 241 parallel to the axis X2 gives rise to a movement of the hook 24 into the open position thereof. The button 23 includes, to this end, additional bearing portions 232 integral with the body of the button 23 and intended to push on the cams 241 when the button 23 is moved into the pressed position thereof.

An example of use of the module 2 is now described in FIGS. 4 to 8.

Figure 4:
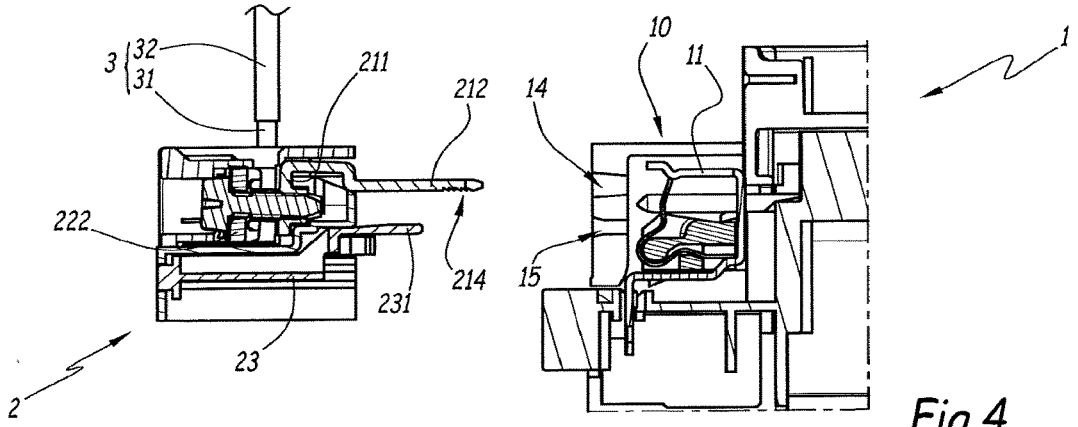
FIG. 4 is a schematic illustration, according to a lateral sectional view, of the connection module and of the switching unit of FIG. 1, disconnected from one another.

Initially, the module 2 is in a disconnected position, as illustrated in FIG. 4. The strips 12 are in the released position. The button 23 is in the rest position thereof. The links 3 are already connected to the pieces 21 of the module 2.

Figure 5:
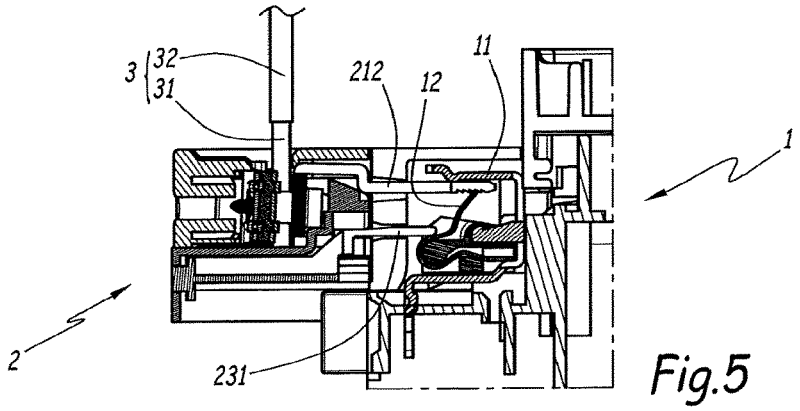
FIGS. 5 and 6 are schematic illustrations, according to a lateral sectional view, of the connection module and of the switching unit of FIG. 1, which are connected to one another.

The module 2 is then brought close to the interface 10 until it enters into contact with the face 13, as illustrated in FIGS. 5 and 7.

As this takes place, the connection portions 212 traverse the slots 14 and enter into contact with the electrical contacts 11, thus establishing an electrical contact between the contacts 11 and the links 3.

The strips 12 are moved slightly by the connection portions 212 and then return to the released position thereof, where they bear on the connection portions 212 in order to promote the contact between the connection portions 212 and the electrical contacts 11 and to oppose the withdrawal thereof.

In practice, the strips 12 do not have to return strictly to the initial position thereof, even when they are released, owing to the presence of the one or more connection portions 212, as illustrated in FIG. 4. However, the strips 12 are then in a position that moves away from the released position only minimally and which, furthermore, is different from the depressed position.

When the notches 214 are present on the connection portions 212 they form stops that cooperate with the free end of the corresponding strip 12 in order further to oppose the withdrawal of the connection portion 212 when the strip 12 is in the released position thereof.

Simultaneously, the bearing portions 231 are able to pass through the slots 15 but, at this stage, they do not bear on the strips 12 since the button 23 is in the rest position.

In parallel, the hooks 24 interlock in the grooves 16 and return elastically to the closed position thereof, in order to lock the module 2 on the unit 1. In this case, also, the portions 232 do not bear on the cams 241 since the button 23 is in the rest position.

Figure 6:
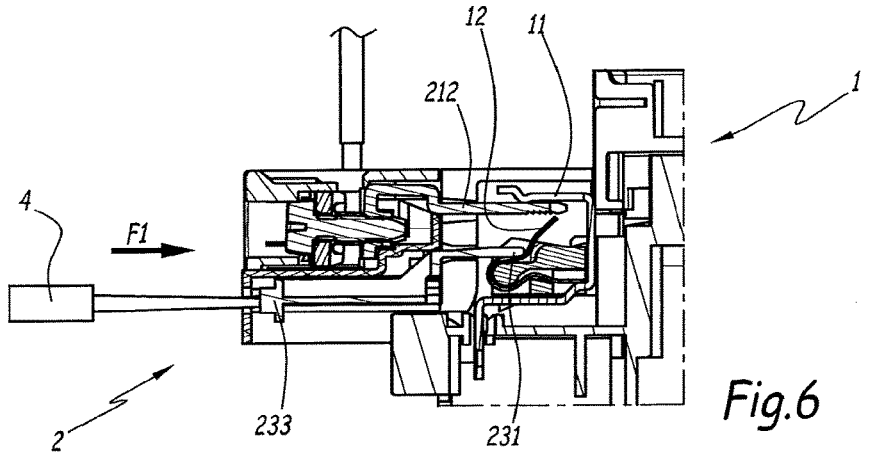

In order to disconnect the module 2 from the unit 1, pressure is exerted on the pusher 233 in order to move the button 23 into the pressed position, as illustrated in FIGS. 6 and 8 by the arrow F1. When this happens, the bearing portions 231 enter into contact with the strips 12 and move the latter into the depressed position thereof in order that they free the connection portions 212.

Simultaneously, through the effect of the movement of the button 23, the additional bearing portions 232 push the cams 241, which causes the hooks 24 to pivot towards the open position thereof, as illustrated in FIG. 8 by the arrows F2 and F2'.

The module 2 is unlocked and may be withdrawn from the unit 1. If the button 23 is elastically biased, it may be necessary to maintain a bearing force on the button 23 during withdrawal from the module 2.

According to variants, the movement of the module 2 is not necessarily a translational movement along the axis X2 but, rather, along a geometric axis that is inclined relative to the face 13. In this case, the arrangements of the pieces 21 and of the button 23 are adapted as a result, for example by inclining the portions 212, and the path of the button 23 is along this axis.

The use of an interchangeable module 2 that is separate from the unit 1 makes it possible to simplify the manufacture of the unit 1 on an industrial scale and also to offer greater flexibility of use. Indeed, instead of having to manufacture as many electrical unit variants as there are possible ways in which to connect the links 3, it is possible to manufacture a unit 1 provided with a standardized connection interface 10 and modules 2 that are each adapted to a connection type, it being understood that a module 2 is less complex and less expensive to manufacture than the unit 1.

Disconnection of the module 2, both electrically and mechanically, is permitted by simple pressure on the button 23 and may be achieved without the need for complex tools, which offers greater flexibility of use.

The module 2 also makes it possible to retain the arrangement of the connections of the links 3 when the unit 1 has to be temporarily disconnected from the electrical installation, for example during maintenance operations. The user is not required to disconnect all the links 3 one by one in order then to reconnect them one by one when he has finished, with the risk of making a mistake when reconnecting them. On the contrary, by virtue of the invention, in order to disconnect the unit 1 from the electrical installation it suffices to disconnect the module 2 from the unit 1. The links 3 do not need to be disconnected from the module 2. This, also, allows greater flexibility of use.

Lastly, the invention makes it possible to obtain an improved mechanical connection. In particular, the locking device limits the likelihood of accidental disconnection of the module 2.

The embodiments and the variants envisaged above may be combined with one another in order to give rise to new embodiments.

The invention claimed is:

1. An interchangeable connection module for electrically connecting an electrical switching unit to an electrical installation with electrical links, the electrical unit comprising a connection interface including at least one electrical contact and at least one elastic holding strip that is deformable between a depressed position and a released position, said connection module being movable between a position wherein the connection module is connected with the unit and a position wherein the connection module is disconnected from the unit, wherein said connection module comprises a casing, at least one connection piece and an actuation button, each connection piece being configured to provide an electrical connection between an end of an electrical link and one of the electrical contacts of the unit when the connection module is connected with the unit, and including at least one connection portion that projects outside the casing each connection piece being held in contact with an electrical contact of the unit by a corresponding elastic holding strip of the unit when this strip is in the released position thereof and the module is connected with the unit, this holding not being exerted when the strip is in the depressed position thereof, the button being translatably movable, relative to the casing of the module, between a rest position and a pressed position and including at least one bearing portion projecting outside the casing when the button is in the pressed position thereof, each bearing portion being adapted in order to move a corresponding deformable elastic strip into the depressed position thereof when the module is connected with the unit and the button is moved into the pressed position thereof, and wherein the connection module includes a locking device that is capable of cooperating with a locking interface of the unit, it being possible to actuate this locking device with the button.

2. The connection module according to claim 1, wherein the locking device comprises pivoting hooks capable of cooperating with grooves formed on the unit and forming a locking interface of the unit, the hooks being arranged in order to be moved from a closed position into an open position when the button is moved from the rest position thereof into the pressed position thereof.

3. The connection module according to claim 2, wherein each hook comprises a cam wherein the button includes at least one additional bearing portion, the cam being aligned with the additional bearing portion such that a force exerted on the cam by the translation of the additional bearing portion gives rise to a movement of the hook into the open position thereof.

4. The connection module according to claim 2, wherein the hooks are formed as a single piece with the casing of the connection module.

5. The connection module according to claim 1, wherein each connection portion is provided with notches that define stops for receiving a free end of the elastic holding strip when this elastic holding strip is in the released position thereof.

6. The connection module according to claim 1, wherein the button comprises a pusher that is proud of and extends outside the casing of the connection module when the button is in the rest position thereof.

7. The connection module according to claim 1, wherein the casing of the connection module comprises an electrically insulating screen that separates the button from the connection pieces.

8. The connection module according to claim 1, comprises, for each connection piece, a fixing element for mechanically connecting an electrical link to a connection piece.

9. The connection module according to claim 1, wherein each connection piece comprises two connection portions, and wherein each connection portion of one and the same piece is held in contact with the corresponding electrical contact by a dedicated elastic holding strip when this strip is in the released position thereof and the module is connected with the unit.

10. An electrical system comprising an electrical switching unit and an interchangeable connection module for electrically connecting the unit to an electrical installation with electrical links, said electrical system comprising the connection module according to claim 1, wherein the electrical unit comprises a connection interface including at least one electrical contact and at least one elastic holding strip, each connection piece being configured to provide an electrical connection between an end of an electrical link and one of the electrical contacts of the unit when the connection module is connected with the unit and comprising at least one connection portion that project outside the casing, and wherein the electrical unit comprises a locking interface that complements the locking device.

11. The system according to claim 10, wherein the unit contains a housing, a wall of which is configured to receive the connection module, wherein the electrical contacts and the elastic holding strips are provided inside the casing behind the wall and wherein the wall includes slots for the passage of the connection portions and the bearing portions.

* * * * *